US011232753B2

(12) United States Patent
Chen et al.

(10) Patent No.: US 11,232,753 B2
(45) Date of Patent: Jan. 25, 2022

(54) DISPLAY PANEL AND DISPLAY DEVICE

(71) Applicant: SHENZHEN CHINA STAR OPTOELECTRONICS SEMICONDUCTOR DISPLAY TECHNOLOGY CO., LTD., Shenzhen (CN)

(72) Inventors: Shujhih Chen, Shenzhen (CN); Shuichih Lien, Shenzhen (CN); Chiayu Lee, Shenzhen (CN)

( * ) Notice: Subject to any disclaimer, the term of this patent is extended or adjusted under 35 U.S.C. 154(b) by 8 days.

(21) Appl. No.: 16/617,510

(22) PCT Filed: Jul. 15, 2019

(86) PCT No.: PCT/CN2019/095944
§ 371 (c)(1),
(2) Date: Nov. 27, 2019

(87) PCT Pub. No.: WO2020/237791
PCT Pub. Date: Dec. 3, 2020

(65) Prior Publication Data

US 2021/0174747 A1 Jun. 10, 2021

(30) Foreign Application Priority Data

May 29, 2019 (CN) ..... 201910455990.0

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2320/064* (2013.01)

(58) Field of Classification Search
None
See application file for complete search history.

(56) References Cited

U.S. PATENT DOCUMENTS 6,384,804 B1 * 5/2002 Dodabalapur ..... G09G 3/3233 345/82
2002/0130883 A1 9/2002 Huang et al.
2006/0214891 A1 9/2006 Hanari et al.
2008/0297452 A1 12/2008 Roush et al.
(Continued)

FOREIGN PATENT DOCUMENTS

CN 1575487 A 2/2005
CN 101315744 A 12/2008
(Continued)

*Primary Examiner* — Nitin Patel
*Assistant Examiner* — Amen W Bogale

(57) ABSTRACT

A display panel and a display device are provided. The display panel includes pixel units arranged in an array, scan signal lines, data signal lines, and pulse width modulation signal lines. Each scan signal line is coupled to a row of the pixel units and outputs a scan signal to the pixel units. Each data signal line is coupled to a column of the pixel units and outputs a data signal to the pixel unit. Each pulse width modulation signal line is coupled to a row of the pixel units and outputs a pulse width modulation signal to the pixel unit and controls lighting time of the pixel unit to achieve different gray levels. The display panel can achieve low brightness driving display and avoid occurrence of excessive brightness caused by excessive current of the light emitting element.

10 Claims, 2 Drawing Sheets

(56) References Cited

U.S. PATENT DOCUMENTS

| | | | | |
|---|---|---|---|---|
| 2009/0058843 | A1* | 3/2009 | Ishizuka | G09G 3/3258 345/213 |
| 2013/0147384 | A1 | 6/2013 | Wu | |
| 2018/0033376 | A1 | 2/2018 | Fu et al. | |
| 2018/0293929 | A1 | 10/2018 | Shigeta et al. | |
| 2019/0073936 | A1* | 3/2019 | Trythall | G02B 27/0179 |
| 2020/0357332 | A1* | 11/2020 | Hung | G09G 3/32 |

FOREIGN PATENT DOCUMENTS

| | | | |
|---|---|---|---|
| CN | 105575333 | A | 5/2016 |
| CN | 108694908 | A | 10/2018 |
| CN | 109637449 | A | 4/2019 |

* cited by examiner

DISPLAY PANEL AND DISPLAY DEVICE

FIELD OF INVENTION

The present disclosure relates to the field of display technologies, and more particularly to a display panel and a display device.

BACKGROUND OF INVENTION

Micro light emitting diode (micro LED) displays have advantages of low power consumption, high color saturation, and high response speed, making the micro LED displays as one of hot technologies of a next generation of mainstream display products. Current micro LED displays control a brightness of light generated by micro LEDs in a pixel circuit by adjusting current supplied to the pixel circuit.

A gray scale voltage of the micro LEDs of the current micro LED display is not easy to set, a driving voltage of diodes is too low, and a driving current flowing through the diodes is too large, which easily causes issues such as excessive brightness of the diodes.

SUMMARY OF INVENTION

An embodiment of the present disclosure provides a display panel and a display device, which can solve issues of excessive brightness of light emitting diodes in the prior art.

In order to solve the above technical problem, a technical solution adopted by an embodiment of the present disclosure is to provide a display panel. The display panel includes a plurality of pixel units arranged in an array, a plurality of scan signal lines, a plurality of data signal lines, and a plurality of pulse width modulation signal lines. Each of the scan signal lines is coupled to a row of the pixel units and is configured to output a scan signal to the row of the pixel units. Each of the data signal lines is coupled to a column of the pixel units and is configured to output a data signal to the column of the pixel units. Each of the pulse width modulation signal lines is coupled to a row of the pixel units and is configured to output a pulse width modulation signal to the row of the pixel units and control a lighting time of the row of the pixel units to achieve different gray levels. The lighting time of each of the pixel units is related to a brightness value of each of the pixel units.

In an embodiment of the present disclosure, each of the pixel units includes at least a light emitting element, a driving switch, a first switch, a second switch, and a storage capacitor. An end of the light emitting element is connected to a common voltage and is configured to provide light to each of the pixel units. A first end of the driving switch is connected to a power supply voltage, and a second end of the driving switch is connected to the light emitting element and is configured to drive the light emitting element to emit light. A first end of the first switch is connected to a control end of the driving switch, and a control end of the first switch is connected to the pulse width modulation signal line. A first end of the second switch is connected to the first end of the first switch, a second end of the second switch is connected to the data signal line, and a control end of the second switch is connected to the scan signal line. A first end of the storage capacitor is connected to the first end of the first switch, and a second end of the storage capacitor is connected to the common voltage.

In an embodiment of the present disclosure, time of the pulse width modulation signal line outputting the pulse modulation signal to the control end of the first switch is later than time of the scan signal line outputting the scan signal to the control end of the second switch.

In an embodiment of the present disclosure, the light emitting element is a micro light emitting diode.

In an embodiment of the present disclosure, the first switch, the second switch, and the driving switch are thin film field effect transistors.

In order to solve the above technical problem, another technical solution adopted by an embodiment of the present disclosure is to provide a display device. The display device includes the above display panel, a scan driving circuit coupled to the scan signal lines and configured to provide scan signals to the pixel units, a data driving circuit coupled to the data signal lines and configured to provide data signals to the pixel units, and a pulse width modulation circuit coupled to the pulse width modulation signal lines and configured to provide pulse modulation signals to the pixel units to control a lighting time of the pixel units to achieve display of different gray levels of the display device.

In an embodiment of the present disclosure, the lighting time of each of the pixel units is related to a brightness value of each of the pixel units.

In an embodiment of the present disclosure, each of the pixel units includes at least a light emitting element, a driving switch, a first switch, a second switch, and a storage capacitor. An end of the light emitting element is connected to a common voltage and is configured to provide light to each of the pixel units. A first end of the driving switch is connected to a power supply voltage, and a second end of the driving switch is connected to the light emitting element and is configured to drive the light emitting element to emit light. A first end of the first switch is connected to a control end of the driving switch, and a control end of the first switch is connected to the pulse width modulation signal line. A first end of the second switch is connected to the first end of the first switch, a second end of the second switch is connected to the data signal line, and a control end of the second switch is connected to the scan signal line. A first end of the storage capacitor is connected to the first end of the first switch, and a second end of the storage capacitor is connected to the common voltage.

In an embodiment of the present disclosure, time of the pulse width modulation signal line outputting the pulse modulation signal to the control end of the first switch is later than time of the scan signal line outputting the scan signal to the control end of the second switch.

Beneficial effects of an embodiment of the present disclosure are that, the display panel and the display device are provided. By adjusting a lighting time length of the pixel unit using the pulse width modulation signal, it is possible to achieve low brightness driving display and avoid occurrence of excessive brightness caused by excessive current of the light emitting element.

DESCRIPTION OF DRAWINGS

The accompanying figures to be used in the description of embodiments of the present disclosure or prior art will be described in brief to more clearly illustrate the technical solutions of the embodiments or the prior art. The accompanying figures described below are only part of the embodiments of the present disclosure, from which figures those skilled in the art can derive further figures without making any inventive efforts.

DETAILED DESCRIPTION OF PREFERRED EMBODIMENTS

The technical solutions in the embodiments of the present disclosure will be clearly and completely described in the following with reference to the accompanying drawings. It is apparent that the described embodiments are only a part of the embodiments of the present disclosure, and not all of the embodiments. All other embodiments obtained by a person skilled in the art based on the embodiments of the present disclosure without creative efforts are within the scope of the present disclosure.

All technical and scientific terms used herein have the same meaning as commonly understood by a person skilled in the art. The terminology used herein is for the purpose of describing particular embodiments, not intended to limit the present disclosure. The terms "comprising" and "having", and any variations thereof, are intended to cover a non-exclusive inclusion in the specification, claims, and the above-mentioned drawings of the present disclosure. The terms "first", "second" and the like in the specification, claims, and the above-mentioned drawings of the present disclosure are used to distinguish different objects and are not intended to describe a specific order.

References to "an embodiment" herein mean that a particular feature, structure, or characteristic described in connection with the embodiments can be included in at least one embodiment of the present disclosure. The appearances of the phrases in various places in the specification are not necessarily referring to the same embodiments and are not exclusive or alternative embodiments that are mutually exclusive. Those skilled in the art can understand and implicitly understand that the embodiments described herein can be combined with other embodiments.

Figure 1:
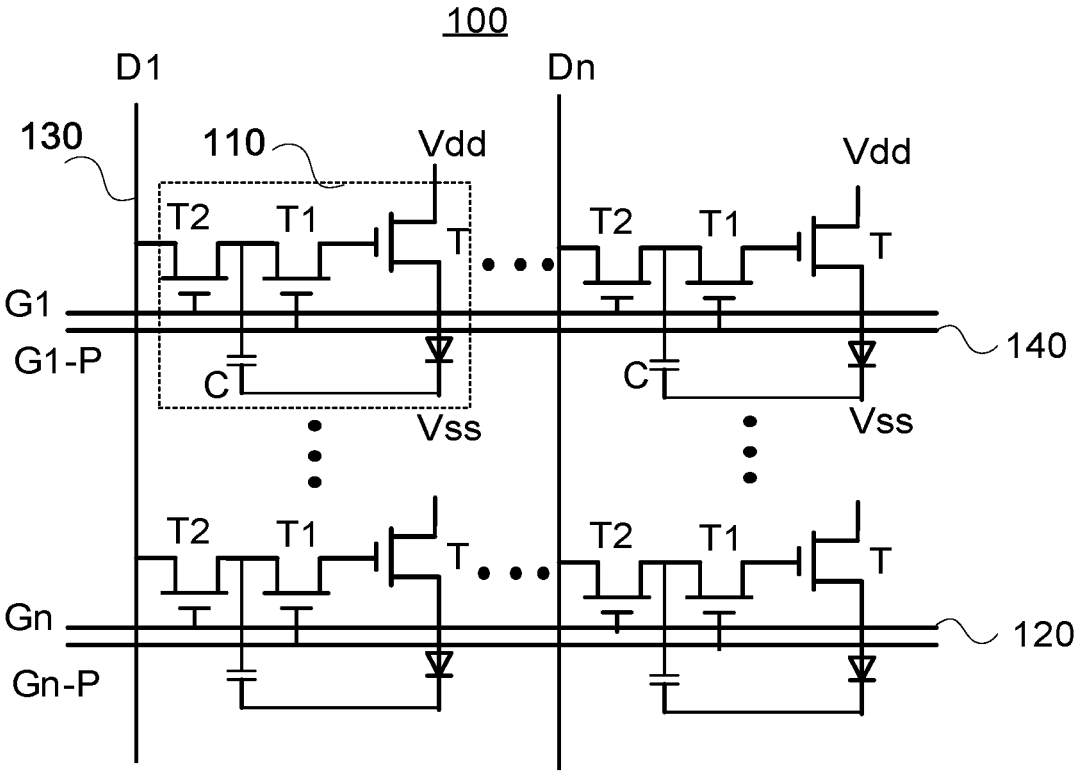
FIG. 1 is a schematic structural view of a display panel according to an embodiment of the present disclosure.

Referring to FIG. 1, FIG. 1 is a schematic structural view of a display panel according to an embodiment of the present disclosure.

A display panel 100 provided in an embodiment of the present disclosure as illustrated in FIG. 1 includes a plurality of pixel units 110, a plurality of scan signal lines 120 (G1, G2, . . . Gn), a plurality of data signal lines 130 (D1, D2, . . . Dn), and a plurality of pulse width modulation signal lines 140 (G1-P, G2-P, . . . Gn-P).

Each of the scan signal lines 120 is coupled to a row of the pixel units 110 and is configured to output a scan signal to the row of the pixel units 110. Each of the data signal lines 130 is coupled to a column of the pixel units 110 and is configured to output a data signal to the column of the pixel units 120.

Optionally, each of the pulse width modulation signal lines 140 is coupled to a row of the pixel units 110 and is configured to output a pulse width modulation signal to the row of the pixel units 110 and control a lighting time of the row of the pixel units 110 to achieve different gray levels.

In the embodiment of the present disclosure, by adjusting a lighting time length of the pixel unit using pulse width modulation (PWM), it is possible to achieve low brightness driving display and avoid occurrence of excessive brightness caused by excessive current of the light emitting element.

Figure 2:
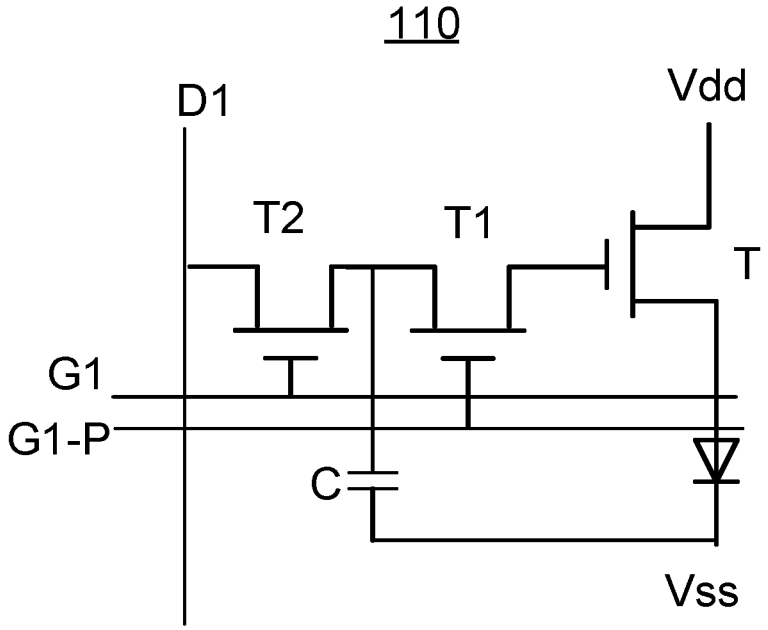
FIG. 2 is a schematic structural view of a pixel unit according to an embodiment of the present disclosure.

Referring to FIG. 2, FIG. 2 is a schematic structural view of a pixel unit according to an embodiment of the present disclosure. Referring to FIG. 2, in the embodiment of the present disclosure, each of the pixel units 110 includes at least a light emitting element 111, a driving switch T, a first switch T1, a second switch T2, and a storage capacitor C.

An end of the light emitting element 111 is connected to a common voltage Vss and is configured to provide light to each of the pixel units 110. The common voltage Vss can be a ground voltage. The light emitting element 111 in the embodiment may be a micro light emitting diode (micro LED), and may be an organic light emitting diode (OLED) or a light emitting diode in other embodiments, which is not specifically limited herein.

A first end of the driving switch T is connected to a power supply voltage Vdd, and a second end of the driving switch T is connected to the light emitting element 111 and is configured to drive the light emitting element 111 to emit light. It is understood that, a value of the power supply voltage Vdd is greater than a value of the common voltage Vss.

A first end of the first switch T1 is connected to a control end of the driving switch T, and a control end of the first switch T1 is connected to the pulse width modulation signal line 140.

A first end of the second switch T2 is connected to the first end of the first switch T1, a second end of the second switch T2 is connected to the data signal line 130, and a control end of the second switch T2 is connected to the scan signal line 120.

A first end of the storage capacitor C is connected to the first end of the first switch T1, and a second end of the storage capacitor C is connected to the common voltage Vss.

Optionally, the driving switch T, the first switch T1, and the second switch T2 are thin film field effect transistors and may be other electronic devices that can implement a switching function, which is not specifically limited in the present disclosure. A first end of a switch may be a drain of the switch, and a second end of the switch may be a source of the switch. In a specific embodiment, the source and the drain of the switch may be interchanged, and there is no specific limit here.

Figure 3:
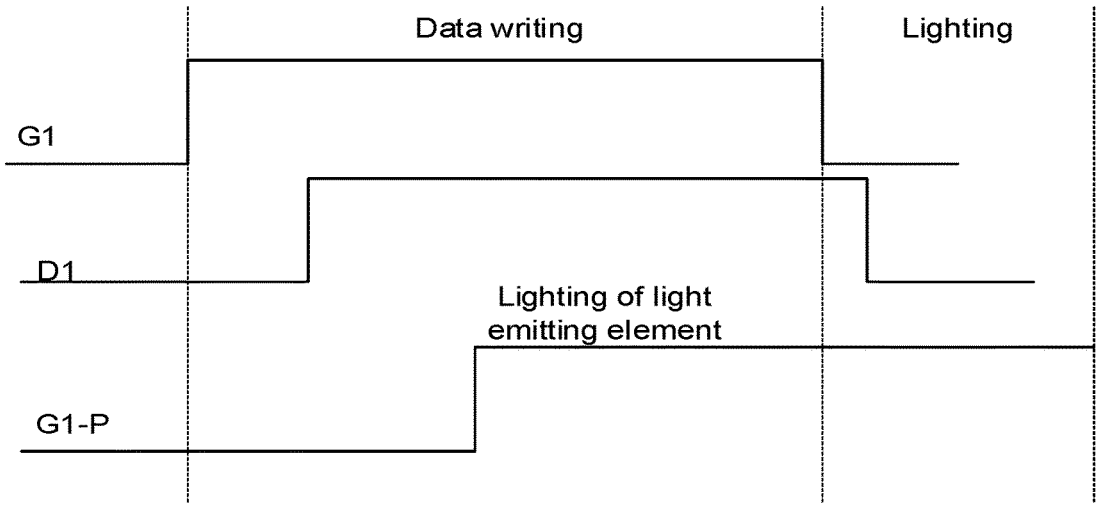
FIG. 3 is a waveform timing diagram of an operation of a pixel unit according to an embodiment of the present disclosure.

Combined with FIG. 3, FIG. 3 is a waveform timing diagram of an operation of a pixel unit according to an embodiment of the present disclosure. As illustrated in FIG. 3, in brief, a driving process of the pixel unit 110 in the embodiment of the present disclosure may include four stages of pixel initialization, threshold generation, data writing, and illuminating writing. The embodiment of the present disclosure mainly introduces the data writing and illuminating writing stages, as follows.

In the data writing phase, the scan signal line 120 and the pulse width modulation signal line 140 do not simultaneously output a signal, that is, in the embodiment of the present disclosure, time of the pulse width modulation signal line 140 outputting the pulse modulation signal to the control end of the first switch T1 is later than time of the scan signal line 120 outputting the scan signal to the control end of the second switch T2. That is, the embodiment of the present disclosure controls lighting time of the light emitting element 111 in the pixel unit 110 by delaying the output of the pulse width modulation signal, thereby realizing display of different gray scales.

Optionally, the lighting time of the light emitting element 111 in the pixel unit 110 in the embodiment of the present disclosure is related to a brightness value of the pixel unit 110. It can be understood that turn-on time of the pulse width modulation signal in one frame, that is, delay time relative to the scan signal, is determined by how much brightness value the pixel unit needs.

Optionally, only the pulse width modulation signal is output to the first switch T1, the first switch T1 is turned on, and the power supply voltage Vdd supplies current to the light emitting element 111, thereby causing the light emitting element 111 to emit light. Lighting time of the light emitting element 111 (output time of the pulse width modulation signal) is related to the brightness value required by the pixel unit, and the brightness value is determined by a dot gamma curve of the display panel 100. For example, the display panel presents 256 gray scales, and each gray scale has a corresponding brightness value, such as G255=100 nits, G32=1 nit, where G represents gray scale and G255 represents 255 gray scales. In a specific application scenario of the embodiment of the present disclosure, taking driving frequency of the display panel as 60 Hz as an example, if the gray scale of the pixel unit 110 to be displayed is G255, turn-on time of the pulse width modulation signal is 16 ms (turn-on time of the first switch T1, that is, the lighting time of the light emitting element 111). Similarly, for G32, its luminance value is one hundredth of G255, and its corresponding pulse width modulation signal can be turned on for 0.16 ms. That is to say, the turn-on time of the pulse width modulation signal can be obtained by knowing a desired point luminance value of each pixel unit 110, such that the lighting time of the light emitting element 111 can be obtained.

Optionally, how much brightness is required for each gray scale can be preset. For details, refer to brightness and time settings of gamma 2.2, as follows.

TABLE 1 reference table of brightness and time settings of gamma 2.2

| Gray Scale | Brightness L (gamma = 2.2) | turn-on time of pulse width modulation signal (us) |
|---|---|---|
| 1 | 0.001 | 0.081 |
| 2 | 0.002 | 0.373 |
| 4 | 0.011 | 1.715 |
| 8 | 0.049 | 7.880 |
| 32 | 1.040 | 166.365 |
| 64 | 4.778 | 764.412 |
| 128 | 21.952 | 3512.315 |
| 255 | 100.00 | 16000.000 |

It can be understood that, for each row of the pixel unit 110 in the display panel 100, the turn-on time of the pulse width modulation signal needs to be delayed, and a length of the delay is related to the brightness value required by the row of pixel units. For details, refer to the detailed description of the above embodiments, and details are not described herein again.

In the embodiment of the present disclosure, time of the pulse width modulation signal line 140 outputting the pulse modulation signal to the control end of the first switch T1 is set to be later than time of the scan signal line 120 outputting the scan signal to the control end of the second switch T2, that is, the turn-on time of the pulse width modulation signal is delayed. The lighting time of the pixel unit can be adjusted to achieve low brightness driving, and the brightness of the light emitting element is prevented from being excessively bright due to excessive current.

In the above embodiment, by adjusting the lighting time of the pixel unit using the pulse width modulation signal, it is possible to achieve low brightness driving, and it is possible to prevent the brightness from being excessively bright due to excessive current of the light emitting element.

Figure 4:
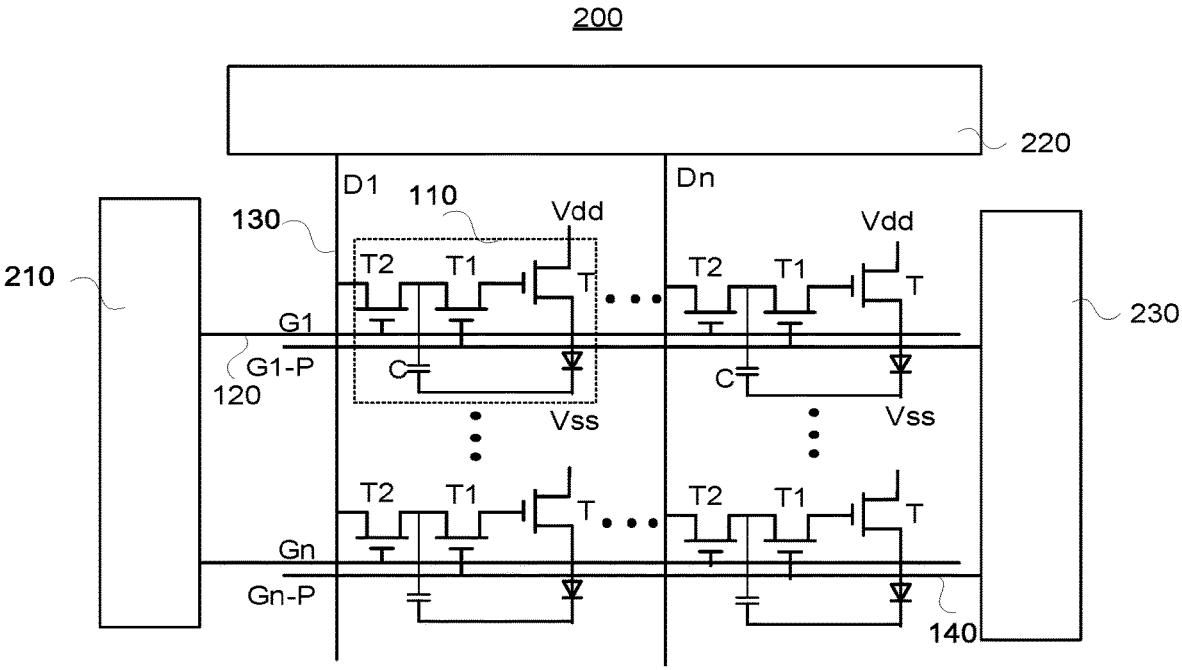
FIG. 4 is a schematic structural view of a display device according to an embodiment of the present disclosure.

Referring to FIG. 4, FIG. 4 is a schematic structural view a display device according to an embodiment of the present disclosure. As illustrated in FIG. 4, a display device 200 of the embodiment of the present disclosure includes a display panel F, a scan driving circuit 210, a data driving circuit 220, and a pulse width modulation circuit 230.

The display panel F further includes a plurality of pixel units 110, a plurality of scan signal lines 120, a plurality of data signal lines 130, and a plurality of pulse width modulated signal lines 140. Specific functions and connection relationships of the pixel units 110, the scan signal lines 120, the data signal lines 130, and the pulse width modulation signal lines 140 can refer to the detailed description in the foregoing embodiments, and details are not described herein again.

Optionally, each of the pixel units 110 includes at least a light emitting element 111, a driving switch T, a first switch T1, a second switch T2, and a storage capacitor C.

An end of the light emitting element 111 is connected to a common voltage Vss and is configured to provide light to each of the pixel units 110. The common voltage Vss can be a ground voltage. The light emitting element 111 in the embodiment may be a micro light emitting diode (micro LED), and may be an organic light emitting diode (OLED) or a light emitting diode in other embodiments, which is not specifically limited herein.

A first end of the driving switch T is connected to a power supply voltage Vdd, and a second end of the driving switch T is connected to the light emitting element 111 and is configured to drive the light emitting element 111 to emit light. It is understood that, a value of the power supply voltage Vdd is greater than a value of the common voltage Vss.

A first end of the first switch T1 is connected to a control end of the driving switch T, and a control end of the first switch T1 is connected to the pulse width modulation signal line 140.

A first end of the second switch T2 is connected to the first end of the first switch T1, a second end of the second switch T2 is connected to the data signal line 130, and a control end of the second switch T2 is connected to the scan signal line 120.

A first end of the storage capacitor C is connected to the first end of the first switch T1, and a second end of the storage capacitor C is connected to the common voltage Vss.

Optionally, the scan driving circuit 210 is coupled to the scan signal lines 120 and is configured to provide scan signals to the pixel units 110.

The data driving circuit 220 is coupled to the data signal lines 130 and is configured to provide data signals to the pixel units 110.

The pulse width modulation circuit 230 is coupled to the pulse width modulation signal lines 140 and is configured to provide pulse modulation signals to the pixel units 110 to control a lighting time of the pixel units 110 to achieve display of different gray levels of the display device 200.

The lighting time of each of the pixel units 110 is related to a brightness value of each of the pixel units 110. Time of the pulse width modulation signal line 140 outputting the pulse modulation signal to the control end of the first switch T1 is later than time of the scan signal line 120 outputting the scan signal to the control end of the second switch T2.

Specific implementation principles of the circuit of the embodiment of the present disclosure can refer to the detailed description in the foregoing implementation manner of the display panel, and details are not described herein again.

In the above embodiment, by adjusting the lighting time of the pixel unit using the pulse width modulation signal, it is possible to achieve low brightness driving, and it is possible to prevent the brightness from being excessively bright due to excessive current of the light emitting element.

In summary, those skilled in the art can easily understand that the embodiment of the present disclosure provides a display panel and a display device, which can achieve low brightness driving using a pulse width modulation signal to adjust lighting time of the pixel unit, to prevent the brightness from being excessively bright due to excessive current of the light emitting element.

The above description is only the embodiment of the present disclosure, and thus does not limit the scope of the present disclosure. The equivalent structure or equivalent process transformations made by the present specification and the contents of the drawings, or directly or indirectly applied to other related technical fields, are all included in the scope of the present disclosure.

The subject matter of the present disclosure can be manufactured and used in the industry with industrial applicability.

What is claimed is:

1. A display panel, comprising:

a plurality of pixel units arranged in an array;

a plurality of scan signal lines, wherein each of the scan signal lines is coupled to a row of the pixel units and is configured to output a scan signal to the row of the pixel units;

a plurality of data signal lines, wherein each of the data signal lines is coupled to a column of the pixel units and is configured to output a data signal to the column of the pixel units; and a plurality of pulse width modulation signal lines, wherein each of the pulse width modulation signal lines is coupled to a row of the pixel units and is configured to output a pulse width modulation signal to the row of the pixel units and control a lighting time of the row of the pixel units to achieve different gray levels;

wherein the lighting time of each of the pixel units is related to a brightness value of each of the pixel units;

wherein if a driving frequency of the display panel is 60 Hz and a gray scale of the pixel units to be displayed is 255, turn-on time of the pulse width modulation signal is 16 ms;

wherein when the gray scale of the pixel units is 1, gamma is 2.2, and a brightness value of the pixel units is 0.001, turn-on time of the pulse width modulation signal is 0.081 us; when the gray scale of the pixel units is 2, gamma is 2.2, and the brightness value of the pixel units is 0.002, the turn-on time of the pulse width modulation signal is 0.373 us; when the gray scale of the pixel units is 4, gamma is 2.2, and the brightness value of the pixel units is 0.011, the turn-on time of the pulse width modulation signal is 1.715 us; when the gray scale of the pixel units is 8, gamma is 2.2, and the brightness value of the pixel units is 0.049, the turn-on time of the pulse width modulation signal is 7.880 us; when the gray scale of the pixel units is 32, gamma is 2.2, and the brightness value of the pixel units is 1.040, the turn-on time of the pulse width modulation signal is 166.365 us; when the gray scale of the pixel units is 64, gamma is 2.2, and the brightness value of the pixel units is 4.778, the turn-on time of the pulse width modulation signal is 764.412 us; and when the gray scale of the pixel units is 128, gamma is 2.2, and the brightness value of the pixel units is 21.952, the turn-on time of the pulse width modulation signal is 3512.315 us.

2. The display panel according to claim 1, wherein each of the pixel units comprises at least:

a light emitting element, wherein an end of the light emitting element is connected to a common voltage and is configured to provide light to each of the pixel units;

a driving switch, wherein a first end of the driving switch is connected to a power supply voltage, and a second end of the driving switch is connected to the light emitting element and is configured to drive the light emitting element to emit light;

a first switch, wherein a first end of the first switch is connected to a control end of the driving switch, and a control end of the first switch is connected to the pulse width modulation signal line;

a second switch, wherein the second switch is connected to the first switch, a second end of the second switch is connected to the data signal line, and a control end of the second switch is connected to the scan signal line; and a storage capacitor, wherein a first end of the storage capacitor is connected to the first end of the first switch, and a second end of the storage capacitor is connected to the common voltage.

3. The display panel according to claim 2, wherein time of the pulse width modulation signal line outputting the pulse modulation signal to the control end of the first switch is later than time of the scan signal line outputting the scan signal to the control end of the second switch.

4. The display panel according to claim 2, wherein the light emitting element is a micro light emitting diode.

5. The display panel according to claim 2, wherein the first switch, the second switch, and the driving switch are thin film field effect transistors.

6. A display device, comprising:

the display panel as claimed in claim 1;

a scan driving circuit coupled to the scan signal lines and configured to provide scan signals to the pixel units;

a data driving circuit coupled to the data signal lines and configured to provide data signals to the pixel units; and a pulse width modulation circuit coupled to the pulse width modulation signal lines and configured to provide pulse modulation signals to the pixel units to control a lighting time of the pixel units to achieve display of different gray levels of the display device.

7. The display device according to claim 6, wherein the lighting time of each of the pixel units is related to a brightness value of each of the pixel units.

8. The display device according to claim 6, wherein each of the pixel units comprises at least:

a light emitting element, wherein an end of the light emitting element is connected to a common voltage and is configured to provide light to each of the pixel units;

a driving switch, wherein a first end of the driving switch is connected to a power supply voltage, and a second end of the driving switch is connected to the light emitting element and is configured to drive the light emitting element to emit light;

a first switch, wherein a first end of the first switch is connected to a control end of the driving switch, and a control end of the first switch is connected to the pulse width modulation signal line;

a second switch, wherein the second switch is connected to the first switch, a second end of the second switch is connected to the data signal line, and a control end of the second switch is connected to the scan signal line; and a storage capacitor, wherein a first end of the storage capacitor is connected to the first end of the first switch, and a second end of the storage capacitor is connected to the common voltage.

9. The display device according to claim 8, wherein time of the pulse width modulation signal line outputting the pulse modulation signal to the control end of the first switch is later than time of the scan signal line outputting the scan signal to the control end of the second switch.

10. A display panel, comprising:

a plurality of pixel units arranged in an array;

a plurality of scan signal lines, wherein each of the scan signal lines is coupled to a row of the pixel units and is configured to output a scan signal to the row of the pixel units;

a plurality of data signal lines, wherein each of the data signal lines is coupled to a column of the pixel units and is configured to output a data signal to the column of the pixel units; and a plurality of pulse width modulation signal lines, wherein each of the pulse width modulation signal lines is coupled to a row of the pixel units and is configured to output a pulse width modulation signal to the row of the pixel units and control a lighting time of the row of the pixel units to achieve different gray levels;

wherein if a driving frequency of the display panel is 60 Hz and a gray scale of the pixel units to be displayed is 255, turn-on time of the pulse width modulation signal is 16 ms;

wherein when the gray scale of the pixel units is 1, gamma is 2.2, and a brightness value of the pixel units is 0.001, turn-on time of the pulse width modulation signal is 0.081 us; when the gray scale of the pixel units is 2, gamma is 2.2, and the brightness value of the pixel units is 0.002, the turn-on time of the pulse width modulation signal is 0.373 us; when the gray scale of the pixel units is 4, gamma is 2.2, and the brightness value of the pixel units is 0.011, the turn-on time of the pulse width modulation signal is 1.715 us; when the gray scale of the pixel units is 8, gamma is 2.2, and the brightness value of the pixel units is 0.049, the turn-on time of the pulse width modulation signal is 7.880 us; when the gray scale of the pixel units is 32, gamma is 2.2, and the brightness value of the pixel units is 1.040, the turn-on time of the pulse width modulation signal is 166.365 us; when the gray scale of the pixel units is 64, gamma is 2.2, and the brightness value of the pixel units is 4.778, the turn-on time of the pulse width modulation signal is 764.412 us; and when the gray scale of the pixel units is 128, gamma is 2.2, and the brightness value of the pixel units is 21.952, the turn-on time of the pulse width modulation signal is 3512.315 us.

* * * * *